US007213275B2

(12) United States Patent
Goettl

(10) Patent No.: US 7,213,275 B2
(45) **Date of Patent: *May 8, 2007**

(54) FLOAT OPERATED HYDRAULIC SUCTION FUSE FOR SWIMMING POOLS

(75) Inventor: John M. Goettl, Phoenix, AZ (US)

(73) Assignee: Paramount Leisure Industries, Inc., Chandler, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/327,583

(22) Filed: Jan. 6, 2006

(65) Prior Publication Data

US 2006/0107453 A1 May 25, 2006

Related U.S. Application Data

(60) Continuation of application No. 11/008,767, filed on Dec. 8, 2004, now Pat. No. 7,055,189, which is a division of application No. 10/417,872, filed on Apr. 16, 2003, now Pat. No. 6,895,608.

(51) Int. Cl.
*E04H 4/00* (2006.01)

(52) U.S. Cl. ..... 4/504; 4/508

(58) Field of Classification Search ..... 4/507
See application file for complete search history.

(56) References Cited

U.S. PATENT DOCUMENTS

| | | | | |
|---|---|---|---|---|
| 5,265,631 | A | 11/1993 | Goettl | 134/111 |
| 5,365,617 | A | 11/1994 | Tarr | 4/508 |
| 5,822,807 | A | 10/1998 | Gallagher et al. | 4/507 |
| 5,878,773 | A | 3/1999 | Robol | 137/112 |
| 5,947,700 | A | 9/1999 | McKain et al. | 417/306 |
| 5,991,939 | A | 11/1999 | Mulvey | 4/504 |
| 6,098,654 | A | 8/2000 | Cohen et al. | 137/467 |
| 6,341,387 | B1 | 1/2002 | Zars | 4/504 |

*Primary Examiner*—Charles E. Phillips
(74) *Attorney, Agent, or Firm*—Cahill, von Hellens & Glazer P.L.C.

(57) ABSTRACT

A hydraulic suction fuse is mounted in a conventional debris collection trap of a swimming pool, spa or the like, to significantly reduce or eliminate any suction force on the bottom or side wall mounted drain of the swimming pool, spa or the like, as a result of the drain becoming essentially wholly covered by a body part of a person or other drain clogging article. Alternatively, the hydraulic suction fuse may be mounted in a compartment in line between the drain and a suction pump of a swimming pool, spa or the like. Thereby, a person captured by the suction force at the drain will be released and the person is free to move away from the drain essentially instantaneously upon contact with the drain. The hydraulic suction fuse is self resetting once inflow through the drain is no longer restricted.

9 Claims, 6 Drawing Sheets

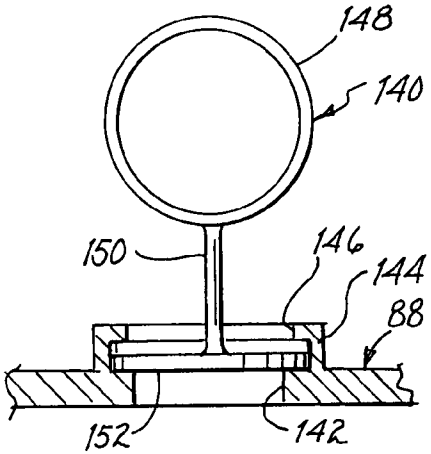
FIG. 5
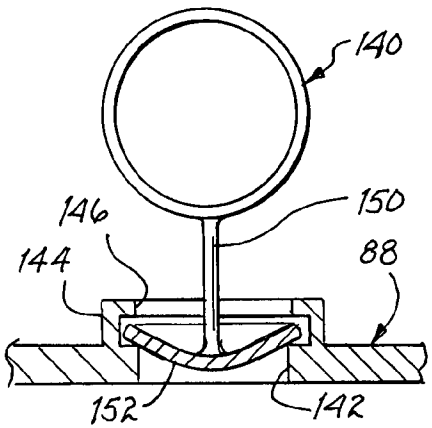
FIG. 6A
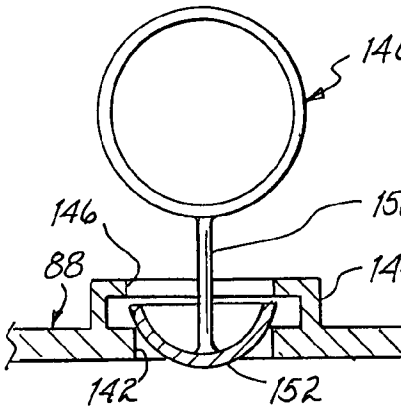
FIG. 6B
FIG. 6C
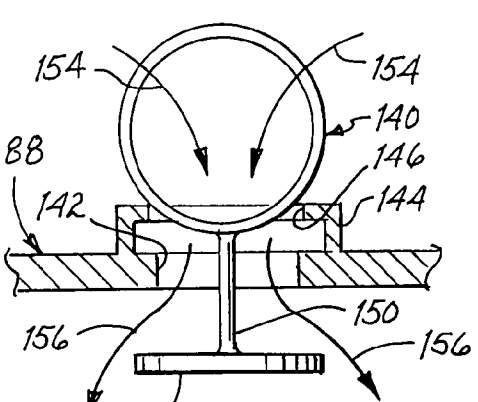
FIG. 6D
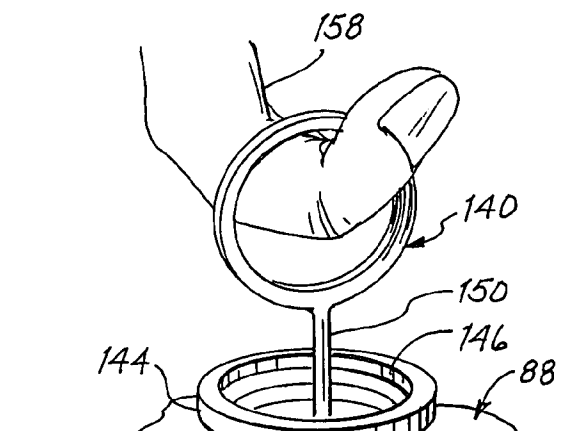
FIG. 7

FLOAT OPERATED HYDRAULIC SUCTION FUSE FOR SWIMMING POOLS

CROSS REFERENCE TO RELATED APPLICATIONS

The present application is a continuation of and claims priority to an application entitled "HYDRAULIC SUCTION FUSE FOR SWIMMING POOLS", assigned Ser. No. 11/008,767, filed Dec. 8, 2004 now U.S. Pat. No. 7,055,189, which application is a division of and claims priority to an application entitled "HYDRAULIC SUCTION FUSE FOR SWIMMING POOLS", filed Apr. 16, 2003, assigned Ser. No. 10/417,872, now U.S. Pat. No. 6,895,608, which application is directed to an invention made by the present inventor and assigned to the present assignee.

BACKGROUND OF THE INVENTION

Typically, swimming pools include a pump for drawing water from a drain at the bottom of a pool through a debris collection trap to a filter from which the water is returned to the pool. Most pools also include a skimmer in fluid communication with the debris collection trap. A typical debris collection trap of this type is illustrated and described in U.S. Pat. No. 5,265,631, which patent describes an invention by the present inventor and is assigned the present assignee.

The drain at the bottom of a swimming pool can pose a safety hazard to an occupant of the pool, particularly a young child or a person of limited physical strength. As water is drawn through the drain by the pump, a suction force exists at the surface of the drain. Should a user of a pool inadvertently cover the drain with a part of his/her body, the suction force will tend to retain the user against the drain unless the user has sufficient strength to push away from the drain. If such strength is not available or if the user panics, drowning may result. Furthermore, even if the user is capable of pushing away from the drain, injury of more or less seriousness may result.

To overcome the potential for injury or drowning due to being drawn against and retained by a swimming pool drain, various devices have been developed over the years to break the pump suction in the event a high suction condition is sensed due to covering or at least restricting the flow of water through the drain. Some of these devices introduce air to the inlet side of the pump in response to the sensed high suction condition, which results in loss of pump prime. Other devices interrupt the power source to the pump and the pump ceases to operate. There are also devices which provide for a conduit open to the atmosphere that is submerged a given distance below the pool water level and connected to the pump inlet to introduce air if a predetermined level of suction is sensed.

There are numerous problems attendant existing prior art devices, which problems will be summarized below. Many of the devices are very expensive and have many moving parts. Some of the devices provide false signals triggered by partly or wholly filled pump and/or skimmer baskets. Installation of some devices may require several feet of excavation for installation purposes which render them expensive and the resulting deterrent may preclude installation. Depending upon the system installed, the pump may be damaged upon actuation with the resulting attendant problems of expense and loss of use of the swimming pool.

BRIEF SUMMARY OF THE INVENTION

The present invention is a hydraulic suction fuse used as part of a debris collection trap, such as described in U.S. Pat. No. 5,265,631, and provides a very economical and dependable safety valve to terminate the suction force that is present at a swimming pool drain should the drain become covered by a body part of a person in the swimming pool. The fuse is mounted in the lid of the debris collection trap. It is a mechanical device, with or without an automatic resetting feature responsive to an above expected suction force within the debris collection trap. Upon existence of the above average suction force, the lid is vented to permit inflow of any water present above the lid and thereafter ambient the air. The presence of the air within the debris collection trap will cause cessation of any suction pressure at the drain and at any connected skimmer. When the drain becomes uncovered, water will flow into the debris collection trap by gravity. Upon fill of the debris collection trap with water, the fuse will close automatically. Thereafter, normal operation will resume.

It is therefore a primary object of the present invention to provide a cessation of a suction force at the drain of a swimming pool if it becomes covered.

Another object of the present invention is to provide a cessation of a suction force at the drain of a swimming pool should it become covered by a body part of an occupant of the swimming pool.

Yet another object of the present invention is to provide a hydraulic suction fuse for preventing an excessive suction force at the drain of a swimming pool.

Still another object of the present invention is to provide a safety valve for preventing a user of a swimming pool from becoming trapped by the suction force at the drain of the swimming pool.

A further object of the present invention is to provide an automatically resettable hydraulic suction fuse for preventing excessive suction force at the drain of a swimming pool.

Yet another object of the present invention is to provide a safety valve for terminating flow through a swimming pool drain upon clogging of the drain.

A still further object of the present invention is to provide an inexpensive hydraulic suction fuse for use with the drain of a swimming pool.

A yet further object of the present invention is to provide a method for preventing an excessive suction force at the drain of a swimming pool.

A yet further object of the present invention is to provide a method for automatically resetting a safety valve actuated due to an excessive suction force at the drain of a swimming pool.

A yet further object of the present invention is to provide a method and apparatus for releasing a person in a swimming pool captured against the drain of the swimming pool.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which:

FIG. 5 illustrates a variant hydraulic suction fuse in its first state;

FIGS. 6A, 6B, 6C and 6D illustrate the change in configuration of the variant hydraulic suction fuse being transformed from the first state to a second state;

FIG. 7 illustrates manual resetting of the variant hydraulic suction fuse.

DESCRIPTION OF THE INVENTION

Figure 1:
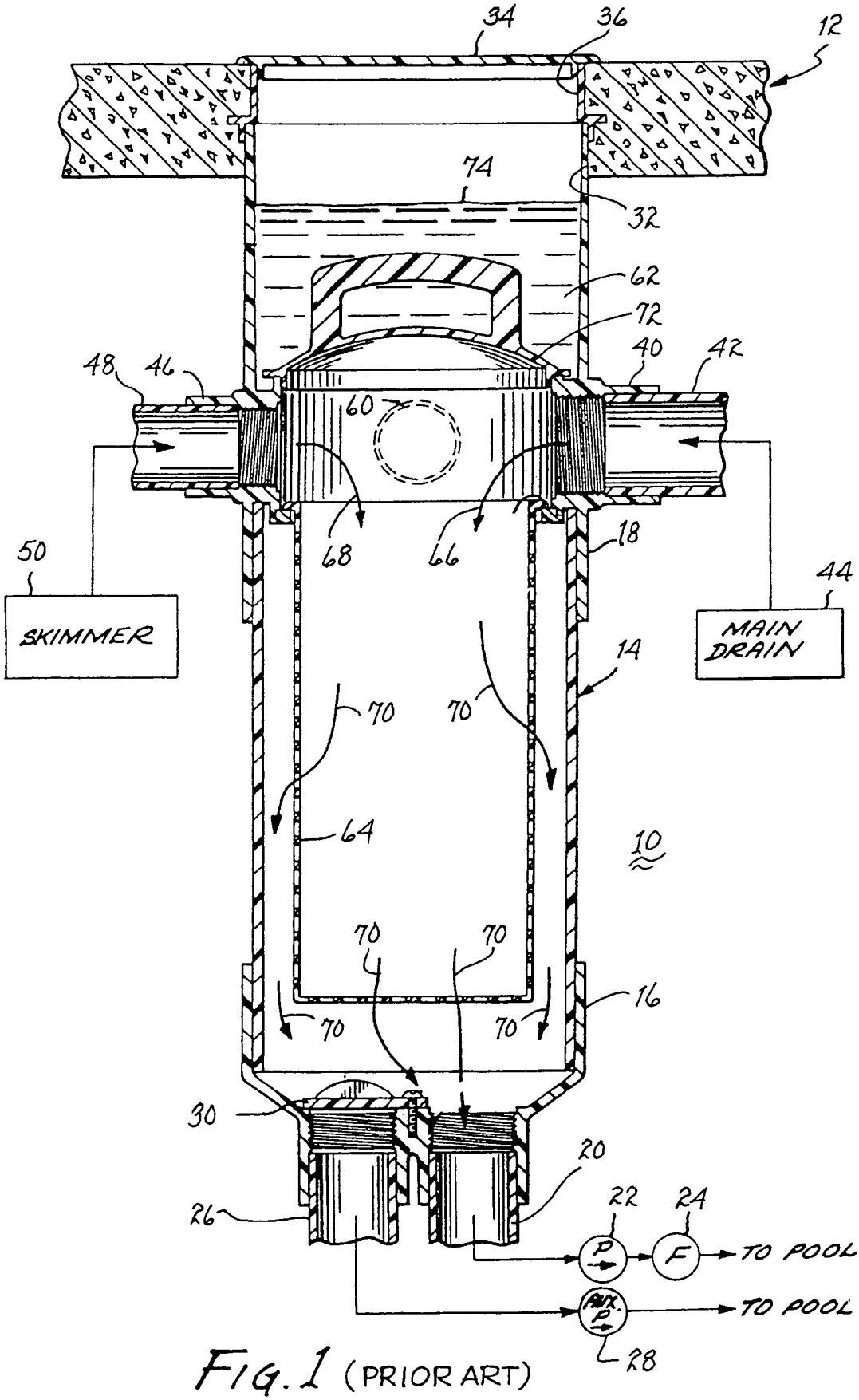
FIG. 1 (PRIOR ART)
FIG. 1 illustrates a conventional prior art debris collection trap for use with a swimming pool.

Referring to FIG. 1, there is illustrated a debris collection trap 10 of the type described in U.S. Pat. No. 5,265,631 (hereinafter referred to as the '631 patent). The trap is located adjacent the side of a swimming pool and recessed below the surface of pool deck 12. Such location permits the trap to be made relatively large for significant capacity without being obtrusive to users of the swimming pool. The trap includes an elongated tank 14 having a bottom closure unit 16 and top inlet unit 18. The closure unit may include a first outflow pipe 20 conveying water to a pump 22 and a filter 24 downstream thereof to filter the water received. The water is then returned to the pool, as indicated. Closure unit 16 may include a second pipe 26 conveying water to an auxiliary pump 28 that provides water to a cooling spray, waterfall, or other water emitting elements attendant the pool, as indicated. A closure 30, such as a pivotal plate illustrated, may be incorporated to selectively limit water flow through pipe 26. The upper extremity of tank 14 is mounted within an opening 32 in pool deck 12. A removable plate 34 supported by the pool deck or by a fitting 36 mounted therein may be employed.

Inlet unit 18 includes a hollow stub 40 for connection to pipe 42 in fluid communication with a drain, such as main drain 44 at the bottom of the swimming pool. A further stub 46 supports a pipe 48 for conveying water from a skimmer 50. An inlet 60 to inlet unit 18 is connected to a balanced line (not shown) for conveying water by gravity from the swimming pool to replenish, as necessary, water 62 within tank 14 above inlet unit 18. A conventional strainer 64 depends from inlet unit 18 and receives water from pipes 42 and 48, along with any debris entrained therein or conveyed thereby, as depicted by arrows 66, 68. The debris flowing into the strainer is retained therein and the water flows out through the strainer and into pipe 20 extending from closure unit 16, as depicted by arrows 70. A cover 72 is detachably attached to inlet unit 18 in sealing engagement therewith. The main purpose of cover 72 is that of providing access to strainer 64 and withdrawal thereof to permit removal of the debris collected therein by drawing the strainer upwardly after removal of plate 34.

In operation, upon actuation of pump 22, water is drawn from within tank 14 and the suction developed within the tank will draw water through main drain 44 and pipe 42 into the tank. Similarly, water will be drawn from skimmer 50 through pipe 48 into the tank. The low pressure or suction within the tank will maintain cover 72 in essentially sealed engagement with inlet unit 18. As inlet 60 is connected via a pipe to the water in the swimming pool, water level 74 of water 62 above cover 72 will be at the same elevation as the water level of the pool. Except for some seepage that may occur due to the below atmosphere pressure within tank 14 below inlet unit 18, water 62 will not mix with the water in the tank below the inlet unit.

Depending in part upon the power of pump 22, the suction (low pressure) within tank 14 may be significant in order to draw water from main drain 44 through pipe 42 into tank 14. This suction pressure (or low pressure) is essentially translated to the opening of the main drain. Should a body part of a person using the swimming pool inadvertently cover the main drain, the resulting suction force (vacuum) would tend to draw the person into contact with the main drain and hold the person there. Should the person be a child or a person of inadequate strength, the person may not be able to move away from the drain and may drown. Furthermore, the person may suffer injuries during efforts to extricate himself/herself away from the drain. If a skimmer 50 is also attached to tank 14 via a pipe 48, the suction otherwise that would be present at the main drain will be somewhat relieved. However, if the skimmer is clogged or nearly clogged, relief of the suction force at the main drain is di minimus.

To prevent the potentially disastrous results of a person becoming captured by the suction force at a main drain of a swimming pool, some mechanism must be employed to minimize or at least reduce the suction force responsible for capturing such person.

Figure 2:
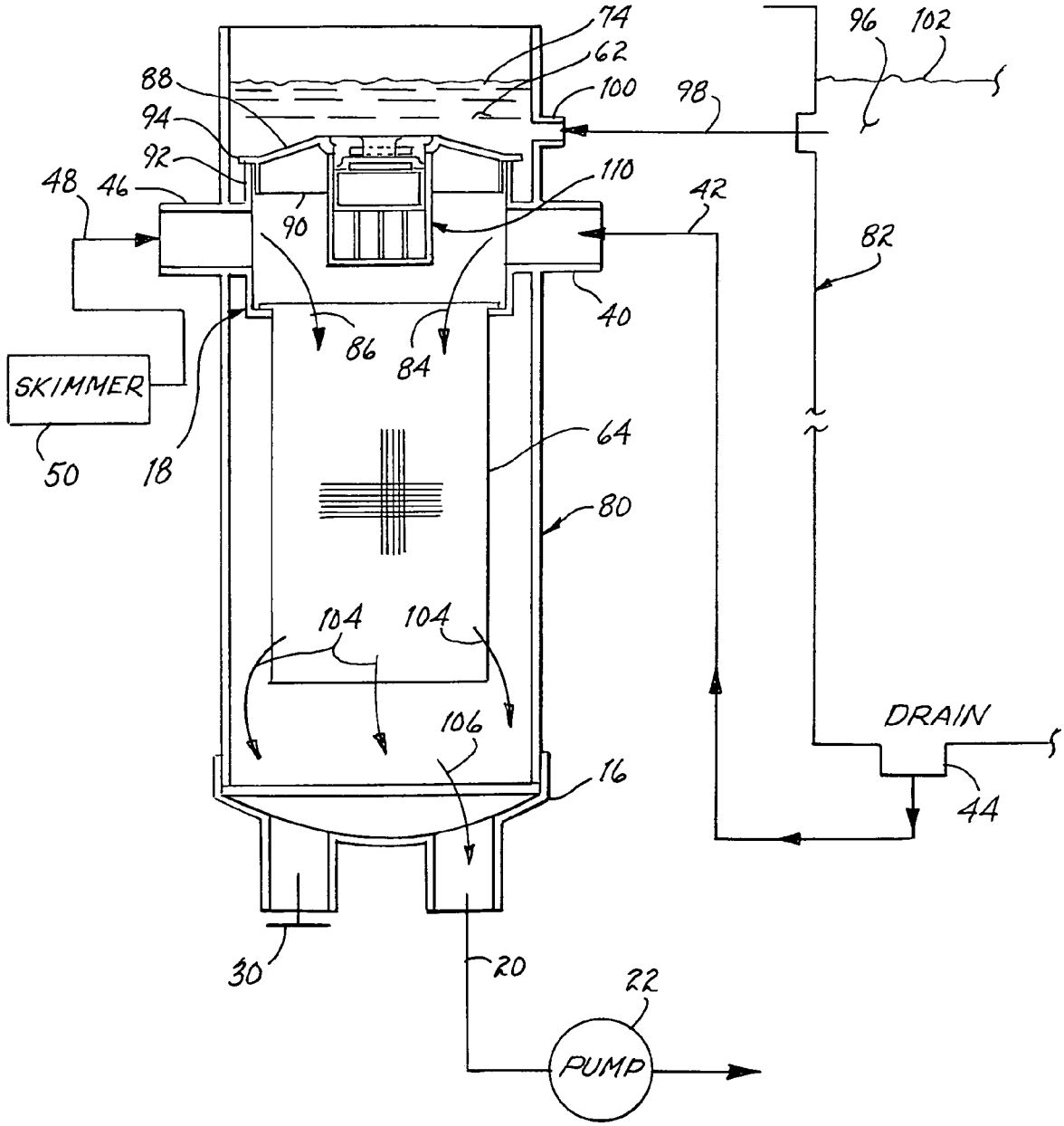
FIG. 2 illustrates a debris collection trap incorporating a hydraulic suction fuse and showing the normal mode of operation.

Referring to FIG. 2, there is illustrated a debris collection trap 80 which may be the same as debris collection trap 10 shown in FIG. 1 or a functional equivalent thereof. In view of the above discussion of debris collection trap 10 shown in FIG. 1, the description of debris collection trap 80 shown in FIG. 2 will be essentially in summary form other than the improvement thereto constituting the present invention. Elements illustrated in FIG. 2 common with elements shown in FIG. 1 will be assigned common reference numerals for identification purposes.

As with debris collection trap 10, debris collection trap 80 is mounted below ground and usually beneath the surface of the deck surrounding a swimming pool, such as pool 82. Inlet unit 18 includes a hollow stub 40 connected to pipe 42 drawing water from drain 44 at the bottom of pool 82. The inflowing water, as a result of suction (low pressure) generated by pump 22 through pipe 20 extending from closure unit 16 enters strainer 64, as depicted by arrow 84. If a skimmer 50 is connected, water is drawn therefrom through pipe 48 into hollow stub 46 and vents into strainer 64, as depicted by arrow 86. A cover 88 is detachably attached to the top of inlet unit 18. It may include a skirt 90 mating with the interior of cylinder 92 at the top of the inlet unit. A circumferential lip 94 rests upon the upper edge of the cylinder to limit movement of cover 88 with respect to the inlet unit. Water 62 above the inlet unit is in fluid communication with water 96 in pool 82 via a pipe or conduit 98 extending from the pool into the debris collection trap via hollow stub 100. Hence, water level 74 at the top of debris collection trap 80 is at the same level as water level 102 in pool 82. As depicted by arrows 104, the water entering strainer 64 flows out of the strainer through the bottom of closure unit 16 into pipe 20, as depicted by arrow 106. The strainer collects the debris, such as leaves, etc., drawn from the pool through drain 44 into the debris collection trap. Upon upward movement of cover 88, the strainer is exposed and it may be removed by lifting it and emptying it at a suitable debris disposal location.

Referring jointly to FIGS. 2, 3A, 3B and 4, hydraulic suction fuse 110 will be described in detail. Cover 88 includes an opening 112 generally centrally located therein and including an inwardly radially extending lip 114 serving in the manner of a shoulder. A disc-like support 116 is disposed within opening 112 and supported by lip 114. It includes a centrally located aperture 118. A magnet, such as a ring magnet 120, is formed in or attached to support 116 in a circumscribing relationship with aperture 118. Support 116 supports a basket 122 extending downwardly therefrom and defined by a plurality of longerons 124 terminated by a base 126, which base may be perforated. A float 128 is captured within basket 122 with the freedom to move vertically within the basket. The float includes a disc 130 of steel or other magnetically responsive material disposed in the upper part of the float. The disc may be fully enclosed, as illustrated, to prevent deterioration by the chemical action of chlorine present in the water of the swimming pool. Similarly, magnet 120 may be fully enclosed within support 116 for the same reason. It is to be understood that the locations of the magnet and the disc may be reversed. Water present within inlet unit 18 (see FIG. 2), will cause float 128 to rise against support 116 and be retained thereagainst by the magnetic force exerted by magnet 120 upon disc 130.

Figure 4:
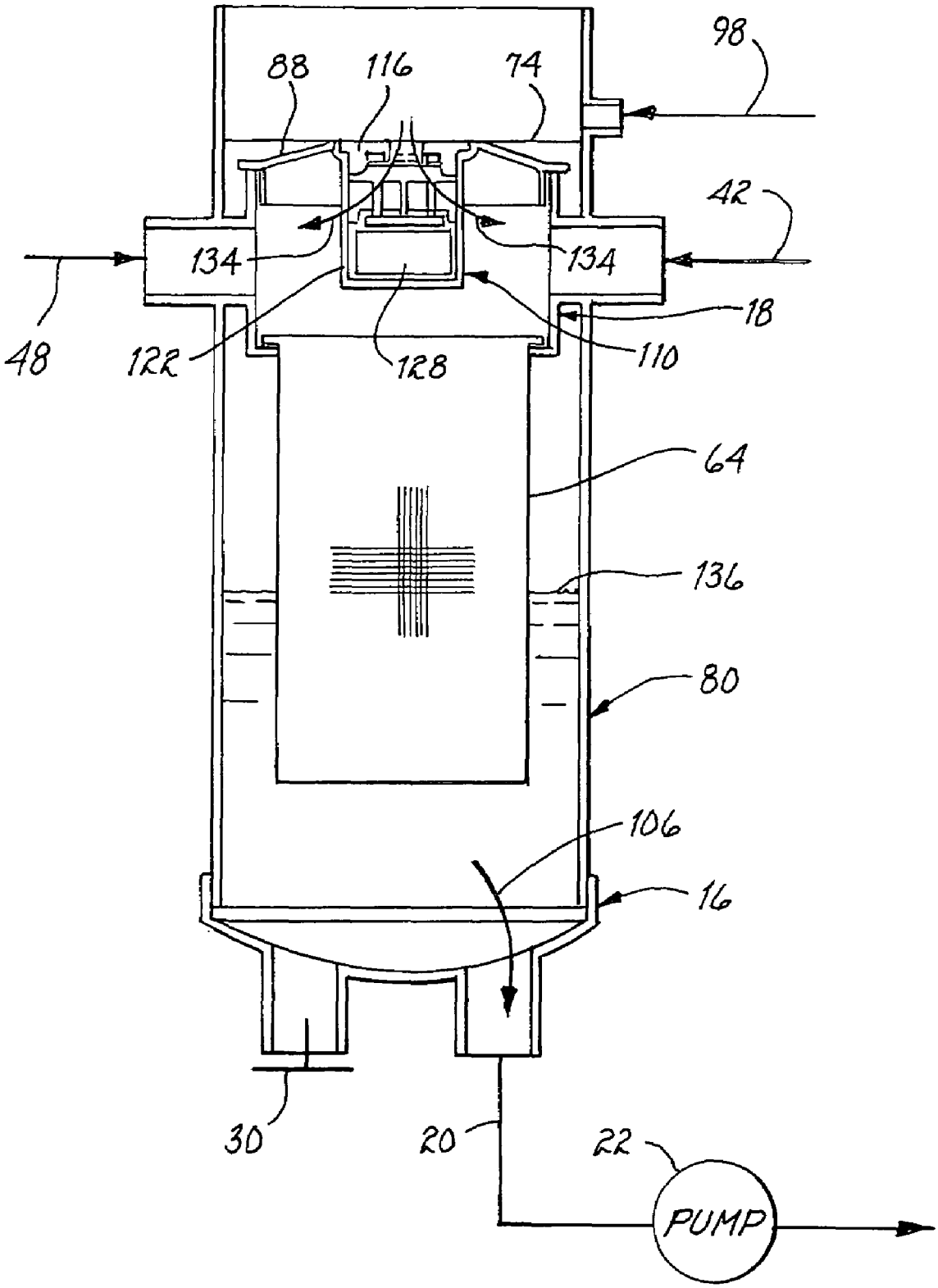
FIG. 4 illustrates a debris collection trap shown in FIG. 2 but wherein the hydraulic suction fuse is in its second state.

When water inflow through pipe 42 (see FIG. 2) into debris collection trap 80 is less than the outflow of water through pipe 20 due to an obstruction at drain 44, water level 136 within the debris collection trap will drop below float 128 and the float will no longer be supported by the water. Additionally, the resulting suction (low pressure) within the debris collection trap relative to the pressure exerted by the head of water 62 above cover 88 will exert a downward force upon float 128. When the combination of lack of water support for the float and the differential pressure acting on the float is sufficient to overcome the magnetic retaining force of magnet 120 acting on disc 130, the float will tend to drop downwardly until it comes to rest against base 126, as shown in FIG. 4. When this happens, the suction force that was present at drain 44 will cease to exist, as described below.

Figure 3A:
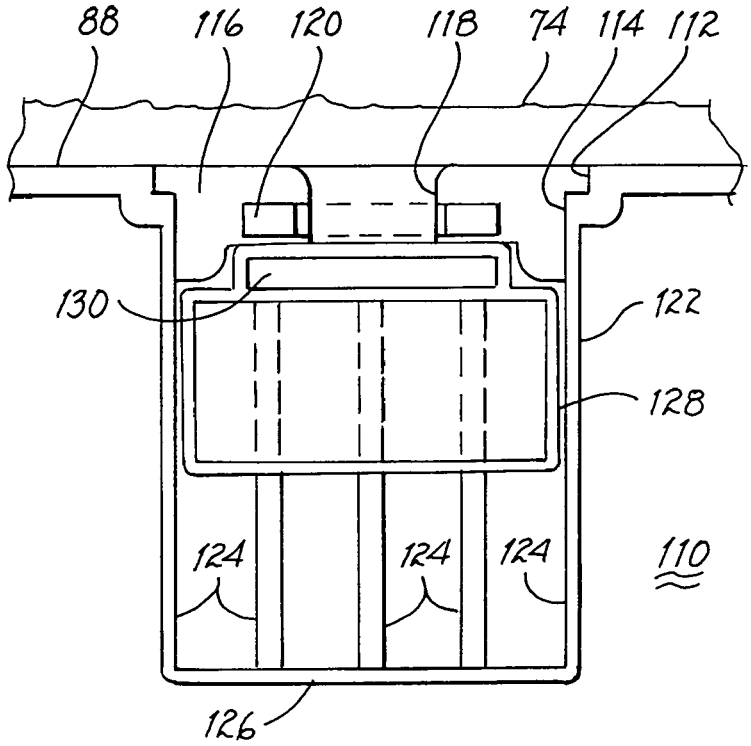
FIG. 3A illustrates a hydraulic suction fuse in a first state representative of normal operation.
Figure 3B:
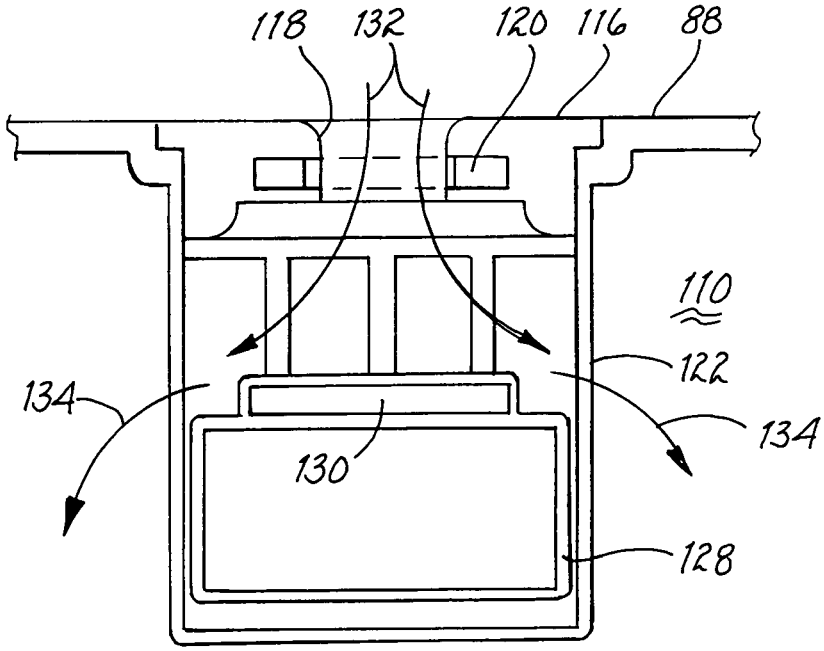
FIG. 3B illustrates the hydraulic suction fuse in a second state resulting from clogging of a drain in a swimming pool.

As particularly shown in FIG. 3B, when float 128 drops to the lower end of basket 122, the water above cover 88 will flow downwardly through aperture 118, as depicted by arrows 132 and into basket 122. As the basket includes a plurality of slots defined by longerons 124 or is otherwise apertured, the water will flow out from basket 122, as depicted by arrows 134 and flow into inlet unit 18. The rate of flow of water through pipe 98 into the debris collection trap above cover 88 is less than the rate of water outflow from the debris collection trap into pipe 20. Hence, aperture 118 will be exposed to the atmosphere. The resulting fluid communication between the interior of inlet unit 18 with the atmosphere (through aperture 118), will essentially eliminate any suction force (vacuum) at stub 40. Such lack of suction force will be translated through pipe 42 to drain 44 resulting in a lack of suction force at the drain. Thus, the suction force tending to retain a body part of a person adjacent the drain will cease to exist and the person will be free to move away from the drain.

Because water level 74 within the debris collection trap will drop and be below water level 102 in pool 82 (see FIG. 2), water will continue to flow through pipe 98 to the top of the debris collection trap. This water flow, being urged by gravity, will be at a lesser rate than the water drawn out of the debris collection trap by pump 22. When air is drawn from the debris collection tank through pipe 20 to pump 22, the impeller associated with the pump will tend to cavitate. Such cavitation will cause the pump not to draw water from the debris collection tank through pipe 20. When drain 44 is no longer obstructed, water will flow through the drain, into pipe 42 and into the debris collection trap as stub 40 is below water level 102 in the pool. The water flowing through aperture 118 of the hydraulic suction fuse into the debris collection trap in combination with the water flowing through stub 40 will fill the debris collection trap as the pump us cavitating and pumping very little water. As the debris collection tank fills float 128 will rise until, at the urging of the magnetic force of magnet 120, closes aperture 118. Thus, the hydraulic suction fuse is self resetting. Such closure will stop further air flow into the debris collection tank and ultimately to pump 22. The downwardly flowing water (but no air) to pump 22 will cause the pump to become primed and begin to draw water from the debris collection tank. Simultaneously, the resulting suction (low pressure) within the debris collection tank will cause water to flow from drain 44 through pipe 42 and through stud 40 into the debris collection tank and normal operation will be resumed.

A hydraulic suction fuse variant 140 is shown in FIG. 5. Cover 88 (see FIGS. 2 and 4) includes a generally centrally located aperture 142. A circular shroud 144, including a radially inwardly extending flange 146, extends upwardly about aperture 142. Variant 140 includes a ring 148 having a stem 150 extending therefrom. A flexible disc 152 is mounted at the lower end of the stem. The disc is configured to be captured interiorly of shroud 144 and of greater diameter than the interior diameter of flange 146. Moreover, the disc is of greater diameter than aperture 142.

Referring jointly to FIGS. 6A, 6B, 6C and 6D, the function of variant 140 will be described. When water within debris collection trap 80 is drawn out through pipe 20 by pump 22 upon covering or clogging of drain 44, suction (vacuum) is developed within the debris collection trap and such suction is not relieved by an inflow of water through pipe 42. The resulting increase in suction will create a pressure differential across disc 152 causing the disc to bend or bow downwardly as illustrated in FIG. 6A. Such bowing will continue, as shown in FIG. 6B until the diameter of the disc approximates the diameter of aperture 142. Thereafter, the disc will be drawn downwardly below cover 88, as shown in FIG. 6C. Further downward movement of variant 140 is prevented by ring 148 interferingly engaging the interior circular edge of flange 146. However, cover 88 has now been opened, as shown in FIG. 6D. Thereafter, water 62 (see FIG. 2) above cover 88 will flow downwardly, as depicted by arrows 154 and through aperture 142, as depicted by arrows 156. The resulting water flow into debris collection trap 80 will maintain pump 22 primed but because debris collection trap 80 is no longer a closed vessel, insufficient suction will be developed therein to draw water through pipe 42. The lack of water flowing into pipe 42 at drain 44 will relieve any suction present at the drain and should a person have been captured by such suction, the person is now free from restraint and can easily move away from the drain; it is to be understood that due to the difference in the water level and of the swimming pool and the water level in the debris collection trap, gravity will cause a water flow of a limited flow rate and the resulting suction at the drain is of little or no consequence.

Variant 140 may be reset, as figuratively depicted in FIG. 7. That is, a person can engage ring 148 with his/her finger 158 and pull upwardly on variant 140. Such upward pull will relocate disc 152 within the confines of shroud 144 and flange 146 above cover 88 defining aperture 142 and the seal of aperture 142 will be reset.

Figure 8:
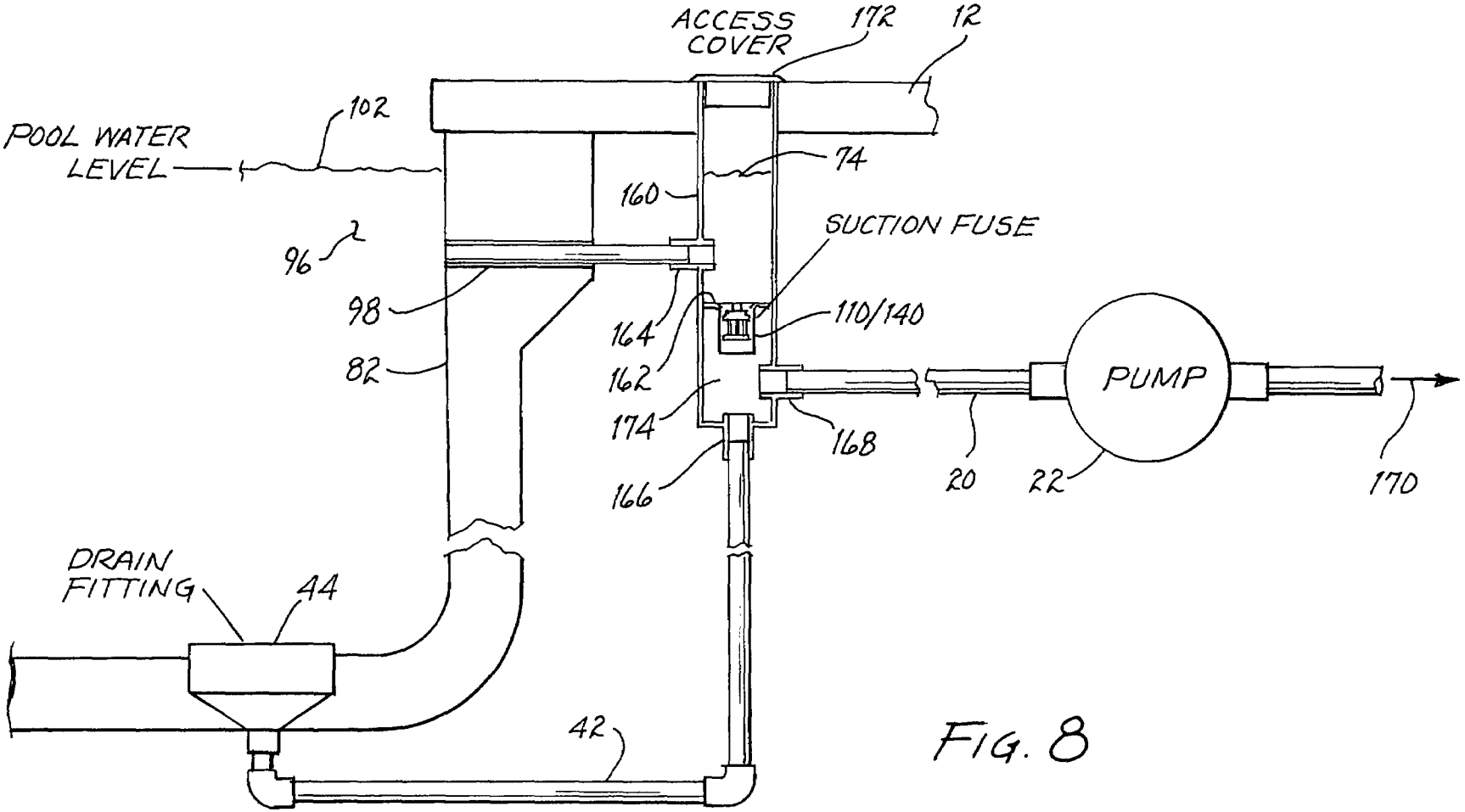
FIG. 8 illustrates a hydraulic suction fuse in line with a swimming pool drain and a pump.

Referring to FIG. 8, there is illustrated a suction fuse 110 or a variant suction fuse 140 at a location adjacent a swimming pool not incorporating a debris collection trap described above. That is, this figure illustrates the possibility of using one of the hydraulic suction fuses described above with any drain, whether at the bottom or in a sidewalk of an existing or to be built swimming pool, spa, or the like.

For elements illustrated in FIG. 8 common with those earlier described, common reference numerals will be used. A cylinder 160 depends from pool deck 12 into the ground. The depth of the cylinder must be sufficient to permit location of the hydraulic suction fuse below water level 102 in swimming pool 82. A bracket 162 supports hydraulic suction fuse 110 in the manner of cover 88 or supports variant hydraulic suction fuse 140 in the manner of cover 88, as shown in FIG. 5 and FIGS. 6A to 6D. Pipe 98 is in fluid communication with water 96 in swimming pool 82 and with the interior of cylinder 160 through stud 164. Thereby, water level 74 within the cylinder is at the same elevation as water level 102 in the swimming pool. Pipe 42 coveys water from drain 44 to stud 166 in fluid communication with the interior of cylinder 160 below bracket 162 (compartment 174). Pipe 20 is in fluid communication with the interior of cylinder 160 below bracket 162 (compartment 174) through stud 168 to convey water to pump 22. The outflow of the pump, represented by arrow 170, is directed to the filtration system of the swimming pool, as is conventional. A conventional cover 172 is removably attached to the upper end of cylinder 160. The cover may include an aperture or fit sufficiently loosely to prevent any pressure differential between the air space at the top of the cylinder and atmospheric pressure.

In operation, in the event drain 44 becomes covered, hydraulic suction fuse 110 will be actuated and air will be caused to enter the cylinder below bracket 162 and be drawn into pump 22, as described above. The resulting lack of suction force within compartment 174 below the bracket will be communicated to drain 44. The resulting lack of suction force at drain 44 will permit easy removal of the material covering the drain or movement of a person away from the drain. Upon such removal of the flow impediment at the drain, compartment 174 will fill through pipe 98 and pipe 42 until hydraulic suction fuse 110 seals itself as a result of the rising water level within compartment 174. Thereafter, flow through the pump from drain 44 will resume.

In the event variant hydraulic suction fuse 140 is actuated, manual resetting of the fuse must be done. Such manual resetting may readily be accomplished by removing cover 172 and reaching into the cylinder to grasp ring 148 of variant hydraulic suction fuse 140 and drawing disc 152 into shroud 144. Thereafter, fluid communication between drain 44 and pump 22 will exist and operation of the pump will resume.

The invention claimed is:

1. A hydraulic suction fuse for use with a swimming pool or spa, said fuse comprising in combination:

a) a compartment disposed at an elevation below the surface of the water in the swimming pool;

b) an apertured support defining the upper end of said compartment;

c) one of a magnet and a magnetically responsive element being attached to said support;

d) a basket supported from said support; and e) a float disposed in said basket for sealing said aperture in said support, said float being adapted to rise and fall within said basket in response to the water level in said compartment, the other of said magnet and said magnetically responsive element being included with said float to urge retention of said float adjacent said support by the magnetic force between said magnet and said magnetically responsive element.

2. A hydraulic suction fuse as set forth in claim 1 wherein said magnet is retained by said support.

3. A hydraulic suction fuse as set forth in claim 2 wherein said magnet is a ring magnet encircling said aperture in said support.

4. A hydraulic suction fuse as set forth in claim 3 wherein said magnetically responsive element is a disc.

5. A hydraulic suction fuse as set forth in claim 1 wherein said basket is apertured.

6. A hydraulic suction fuse apparatus for use with a swimming pool or a spa, said apparatus comprising in combination:

a) a debris collection trap for receiving water from a drain of the swimming pool or spa;

b) an outlet for conveying water from said debris collection trap to a suction pump;

c) a cover for said debris collection trap, said cover including an opening;

d) an apertured support supported within the opening of said cover;

e) a basket extending from said support; and f) a float disposed in said basket, said float being adapted to be repositioned vertically in response to the water level in said debris collection trap and to seal the aperture in said support when said debris collection trap is full of water.

7. An apparatus as set forth in claim 6 including one of a magnet and a magnetically responsive clement being secured by said support and the other of said magnet and said magnetically responsive element being secured by said float.

8. An apparatus as set forth in claim 6 including a magnet secured by said support and a magnetically responsive element secured by said float.

9. An apparatus as set forth in claim 8 wherein said magnet is a ring magnet circumscribing the aperture in said support.

* * * * *